US010044151B2

(12) United States Patent
Jeong

(10) Patent No.: US 10,044,151 B2
(45) Date of Patent: Aug. 7, 2018

(54) SHIELD WIRE GROUNDING DEVICE OF ELECTRIC EQUIPMENT

(71) Applicant: MANDO CORPORATION, Gyeonggi-do (KR)

(72) Inventor: Seung Ho Jeong, Gyeonggi-do (KR)

(73) Assignee: MANDO CORPORATION, Gyeonggi-Do (KR)

( * ) Notice: Subject to any disclaimer, the term of this patent is extended or adjusted under 35 U.S.C. 154(b) by 0 days.

(21) Appl. No.: 15/641,226

(22) Filed: Jul. 4, 2017

(65) Prior Publication Data

US 2018/0013242 A1 Jan. 11, 2018

(30) Foreign Application Priority Data

Jul. 5, 2016 (KR) ..... 10-2016-0084876

(51) Int. Cl.

*H01R 13/648* (2006.01)
*H01R 13/6592* (2011.01)
*H01R 13/6599* (2011.01)
*H01R 105/00* (2006.01)

(52) U.S. Cl.

CPC ..... *H01R 13/6592* (2013.01); *H01R 13/6599* (2013.01); *H01R 2105/00* (2013.01); *H01R 2201/26* (2013.01)

(58) Field of Classification Search

CPC ..... H01R 13/6592; H01R 13/6596
USPC ..... 439/607.28; 174/104, 539, 373
See application file for complete search history.

(56) References Cited

U.S. PATENT DOCUMENTS 6,583,352 B2 * 6/2003 Fukushima ..... H01R 9/032 174/373
6,815,610 B2 * 11/2004 Kuboshima ..... H01R 9/032 174/360
6,943,319 B2 * 9/2005 Jones ..... H05B 3/56 174/103
7,094,970 B2 * 8/2006 Kihira ..... B60L 11/1803 174/74 R
7,390,221 B2 * 6/2008 Akino ..... H01R 9/0518 439/108
7,470,150 B2 * 12/2008 Kuo ..... H01R 9/032 439/607.41
7,500,878 B2 * 3/2009 Akino ..... H01R 9/0518 439/108
7,697,708 B2 * 4/2010 Akino ..... H04R 19/04 381/174
7,922,532 B2 * 4/2011 Su ..... H01R 13/648 439/607.23

(Continued)

FOREIGN PATENT DOCUMENTS

KR 10-2007-0035192 3/2007

*Primary Examiner* — Tulsidas C Patel
*Assistant Examiner* — Peter G Leigh
(74) *Attorney, Agent, or Firm* — Ladas & Parry, LLP

(57) ABSTRACT

Disclosed herein is a shield wire grounding device of electric equipment, including: an electric equipment wire electrically connected to the electric equipment, covered by a first sheath, and having an end portion exposed to the outside of the first sheath; a shield wire installed outside the first sheath, and covered by a second sheath; an insulating member covering the exposed portion of the electric equipment; and a grounding member covering the shield wire and the insulating member, electrically connected to the shield wire, and grounded to an electric equipment housing.

12 Claims, 3 Drawing Sheets

(56) References Cited

U.S. PATENT DOCUMENTS

| | | | | |
|---|---|---|---|---|
| 8,235,553 | B2 * | 8/2012 | Minami | B60Q 1/0094<br>362/263 |
| 8,803,006 | B2 * | 8/2014 | Imahori | H01R 9/032<br>174/539 |
| 2006/0046570 | A1 * | 3/2006 | Akino | H01R 9/032<br>439/607.41 |
| 2012/0000692 | A1 * | 1/2012 | Tsuchiya | H01R 4/726<br>174/107 |
| 2014/0179161 | A1 * | 6/2014 | Imahori | H01R 13/6592<br>439/607.45 |
| 2014/0216805 | A1 * | 8/2014 | Adachi | H01B 7/182<br>174/350 |

* cited by examiner

[FIG. 1]
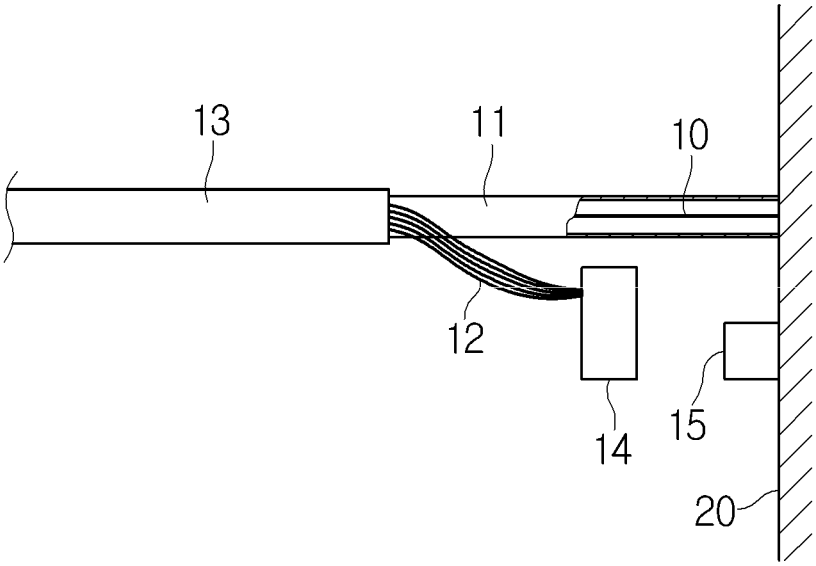
[FIG. 2]
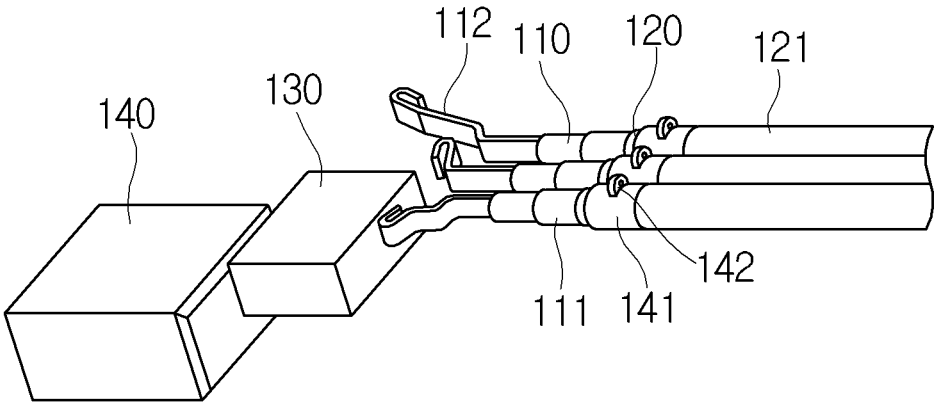

[FIG. 3]
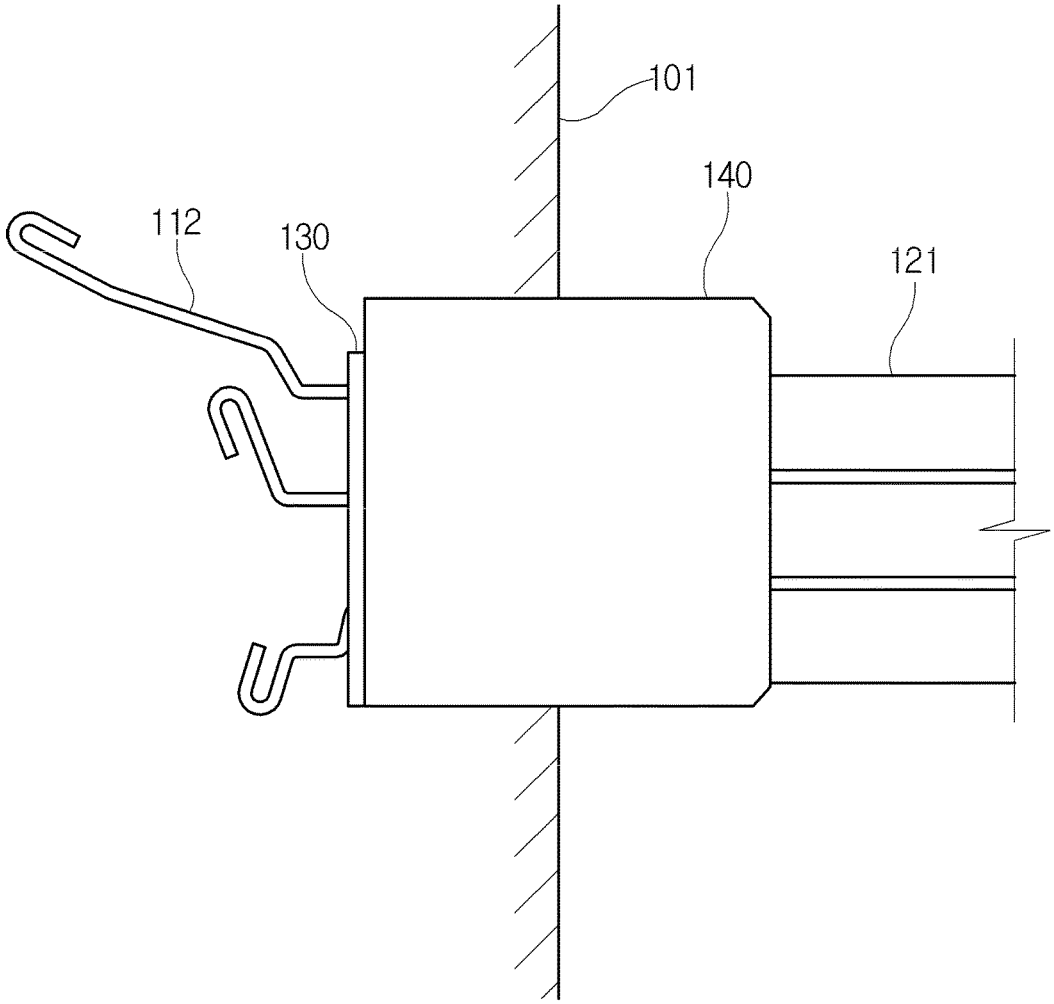

[FIG. 4]
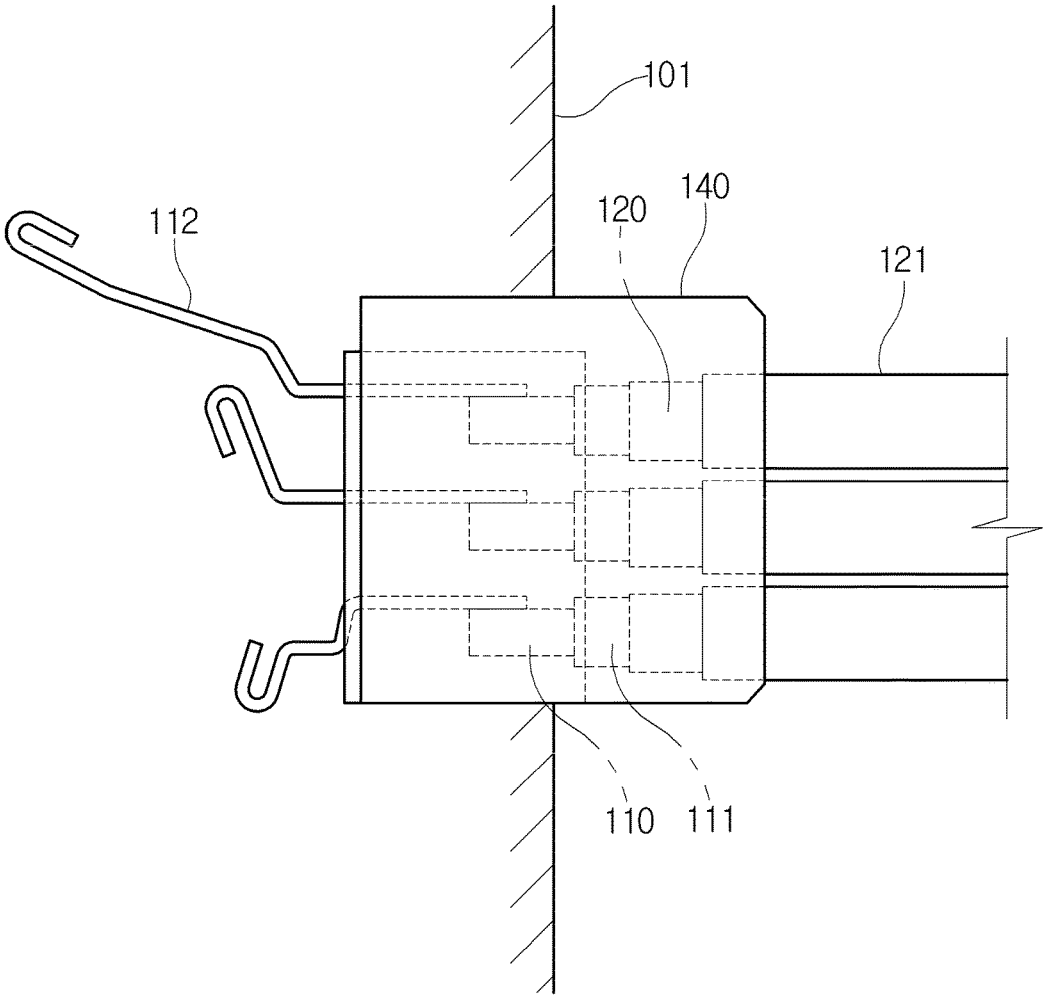

SHIELD WIRE GROUNDING DEVICE OF ELECTRIC EQUIPMENT

CROSS-REFERENCE TO RELATED APPLICATIONS

This application claims priority to Korean Patent Application No. 10-2016-0084876, filed on Jul. 5, 2016, the disclosure of which is incorporated herein by reference in its entirety.

BACKGROUND OF THE INVENTION

Field of the Invention

Exemplary embodiments of the present invention relate to a shield wire grounding device of electric equipment, and more particularly, to a shield wire grounding device of electric equipment, which is capable of not only improving workability, but also preventing a damage of a shield wire, when the shield wire for shielding electromagnetic waves is grounded to a housing of electric equipment.

Description of the Related Art

Recently, with the increase in use of various electronic devices, electronic and communication devices have been digitalized and miniaturized, thereby exhibiting poor resistance to external electromagnetic waves. Thus, in order to protect various electronic and communication devices from electromagnetic interference (EMI), to prevent a trouble of peripheral devices by electromagnetic waves generated from an electromagnetic wave source, and to reduce the harmfulness of electromagnetic waves, an electromagnetic wave shielding unit is installed inside or outside of electronic and communication devices or on a wire. For example, when the wire is installed in a vehicle, a ground wire needs to be connected to an electromagnetic wave shield wire through a terminal.

FIG. 1 illustrates a structure for grounding a shield wire to an electric equipment housing in electric equipment to which the shield wire is applied.

As illustrated in FIG. 1, the shield wire grounding structure of electronic equipment according to the related art includes an electric equipment wire 10, a shield wire 12, a terminal 14 and a terminal connection terminal 15. The electric equipment wire 10 is connected to an external power supply to supply electricity to the electric equipment, and covered by a first sheath 11. The shield wire 12 is installed around the outer circumference of the first sheath 11 so as to shield electromagnetic waves, and covered by a second sheath 13. The terminal 14 is connected to an end of the shield wire 12. The terminal connection terminal 15 protrudes from the outside of an electric equipment housing 20.

The shield wire 12 includes a plurality of micro wires such as coils, which are twisted in a mesh shape, and covers the outer circumference of the first sheath 11 that covers the electric equipment wire 10.

The terminal 14 is made of a conductive material through which electricity can flow, formed in a rectangular shape, and presses an end of the shield wire 12 while being folded along the center thereof. The opposite end of the terminal 14 which presses and fixes the shield wire 12 is bended to form an insertion hole into which the terminal connection terminal 15 is inserted.

The terminal connection terminal 15 is formed on the outer circumference of the electric equipment housing 20, and has a protrusion shape which can be inserted into the insertion hole of the terminal 14.

The shield wire grounding structure of electric equipment according to the related art has the following problems: an operator must fix an end of the terminal 14 to an end of the shield wire 12 using a tool, the terminal 14 being separately installed to ground the shield wire 12 to the electric equipment housing 20, and then bend the other end of the terminal 14 to form the insertion hole into which the terminal connection terminal 15 is inserted. In other words, the shield wire grounding structure may complicate the work, and require a large amount of time.

Furthermore, since the shield wire 12 and the terminal 14 which are coupled to the terminal connection terminal 15 protruding from the outside of the electric equipment housing 20 are exposed to the outside, the shield wire 12 may be damaged by interference of external other parts or interference of other factors.

RELATED ART DOCUMENT

Patent Document

Korean Patent Laid-Open Publication No. 10-2007-0035192 published on Mar. 30, 2007

SUMMARY OF THE INVENTION

The present invention has been made in view of the above problems, and it is an object of the present invention to provide a shield wire grounding device of electric equipment, which is capable of protecting a shield wire and facilitating an operation of grounding the shield wire, through a change of a structure for connecting the shield wire to an electric equipment housing.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a shield wire grounding device of electric equipment may include: an electric equipment wire electrically connected to the electric equipment, covered by a first sheath, and having an end portion exposed to the outside of the first sheath; a shield wire installed outside the first sheath, and covered by a second sheath; an insulating member covering the exposed portion of the electric equipment wire; and a grounding member covering the shield wire and the insulating member, electrically connected to the shield wire, and grounded to an electric equipment housing.

The grounding member may be integrated with the outsides of the shield wire and the insulating member through injection molding.

The shield wire may have one end portion exposed to the outside of the second sheath, with a connection terminal installed at the exposed portion of the shield wire. At this time, the connection terminal may electrically connect the grounding member to the shield wire.

The connection terminal may have a locking protrusion formed protrusively thereon.

The locking protrusion may be formed in a direction perpendicular to the longitudinal direction of the electric equipment wire.

The insulating member may have an end portion exposed to the outside of the grounding member.

The shield wire grounding device may further include a connection terminal connected to the end portion of the electric equipment wire.

The connection terminal may have a portion covered by the insulating member.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a cross-sectional view illustrating a shield wire grounding structure of electric equipment according to the related art;

FIG. 2 is a perspective view illustrating a shield wire grounding structure of electric equipment according to a first embodiment of the present invention;

FIG. 3 is a plan view illustrating the shield wire grounding structure of electric equipment in FIG. 2; and FIG. 4 is a cross-sectional view illustrating the shield wire grounding structure of electric equipment in FIG. 2.

DESCRIPTION OF SPECIFIC EMBODIMENTS

In the accompanying drawings, the thickness or size of each layer is exaggerated, omitted, or schematically illustrated for convenience in description and clarity. Furthermore, the terms as used herein are defined by taking functions of the invention into account and can be changed according to the custom or intention of users or operators. Therefore, definition of the terms should be made according to the overall disclosures set forth herein. The embodiments of the present invention are only examples of components described in claims, and do not limit the scope of the present invention, and claims must be analyzed on the basis of the technical idea throughout the present specification.

FIG. 2 is a perspective view illustrating a shield wire grounding structure of electric equipment according to a first embodiment of the present invention, FIG. 3 is a plan view illustrating the shield wire grounding structure of electric equipment in FIG. 2, and FIG. 4 is a cross-sectional view illustrating the shield wire grounding structure of electric equipment in FIG. 2.

As illustrated in FIGS. 2 to 4, the shield wire grounding device of electric equipment according to the first embodiment of the present invention includes an electric equipment wire 110, a shield wire 120, an insulating member 130, and a grounding member 140. The electric equipment wire 110 is covered by a first sheath 111, and has an end portion of which the first sheath 111 is peeled off to electrically connect the end portion to the electric equipment. The shield wire 120 is installed on the outer circumference of the first sheath 111 covering the electric equipment wire 110, and serves to shield electromagnetic waves. The insulating member 130 covers a part of the end portion of the electric equipment wire 110, which is exposed at the end of the first sheath 111 and electrically connected to the electric equipment, and insulates the exposed part of the electric equipment wire 110. The insulating member 130 is injection molded with the electric equipment wire 110. The grounding member 140 covers the insulating member 130, and is electrically connected to the shield wire 120 exposed to the outside of the first sheath 111. The grounding member 140 is injection molded with the insulating member 130 and the shield wire 120.

The electric equipment wire 110 serves to supply power to the electric equipment or transmit a signal to the electric equipment. One end portion of the electric equipment wire 110 is connected to the electric equipment, for example, a power supply unit or signal transmission unit, and the other end portion of the electric equipment wire 110 is connected to an external power supply. The electric equipment wire 110 is covered and protected by the separate first sheath 111, and the end portion of the electric equipment wire 110, which is connected to the electric equipment, is exposed to the outside with the first sheath 111 peeled off.

The shield wire 120 is disposed outside the first sheath 111 covering the electric equipment wire 110, and the outside of the shield wire 120 is covered and protected by a second sheath 121 made of an insulating material.

The insulating member 130 covers a part of the end portion of the electric equipment wire 110, which is exposed to the outside with the first sheath 111 peeled off, and insulates the exposed part of the electric equipment wire 110. The insulating member 130 is injection molded with the exposed end portion of the electric equipment wire 110.

That is, the exposed end portion of the electric equipment wire 110 is placed in a mold for forming the insulating member, and integrated with the electric equipment wire 110 when the insulating member 130 is injection molded.

Then, a separate first connection terminal 112 is fixed to the end portion of the electric equipment wire 110, where the first sheath 111 is peeled off. The first connection terminal 112 is connected to the electric equipment power supply unit or signal transmission unit installed in an electric equipment housing 101.

Therefore, the insulating member 130 covers a part of the first connection terminal 112 while completely covering the end portion of the electric equipment wire 110 where the first sheath 111 is peeled off, and prevents the electric equipment wire 110 and the part of the first connection terminal 112 from being in contact with the electric equipment housing 101. That is, the insulating member 130 insulates the electric equipment wire 110 from a conductive material such as the electric equipment housing 101.

The grounding member 140 covers the insulating member 130 and the shield wire 120 which is exposed to the outside with the second sheath 121 peeled off, and partially exposes an end portion of the insulating member 130, facing the electric equipment. That is, the grounding member 140 does not completely cover the insulating member 130 so as not to be in contact with the electric equipment wire 110 or the first connection terminal 112, but exposes a part of the end portion of the insulating member 130 at the electric equipment.

The grounding member 140 includes a second connection terminal 141 connected to the shield wire 120 which is exposed to the outside with the second sheath 121 peeled off. The second connection terminal 141 is coupled to the shield wire 120, and made of a conductive material for connecting the grounding member 140 and the shield wire 120.

The second connection terminal 141 has a locking protrusion 142 formed on the outside thereof, the locking protrusion 142 protruding in a direction perpendicular to the longitudinal direction of the electric equipment wire 110. The locking protrusion 142 serves to prevent the grounding member 140 from separating from the shield wire 120 in the longitudinal direction of the electric equipment wire 110, with the grounding member 140 formed with the shield wire 120 and the insulating member 130.

The grounding member 140 is formed by mixing a conductive powder or liquid material with a liquid plastic material during injection molding. Thus, the grounding member 140 can be electrically connected to the shield wire 120 and the electric equipment housing 101.

An application of the shield wire grounding structure of electric equipment according to the embodiment of the present invention will be briefly described.

First, the outermost portion of the second sheath 121 covering the shield wire 120 in an electric equipment cable having the shield wire 120 integrated therewith is peeled off by a predetermined length, in order to expose a part of the shield wire 120 to the outside.

Then, the shield wire 120 is cut to a length that is smaller than the electric equipment wire 110 and the first sheath 111 and larger than the second sheath 121.

Then, the first sheath 111 is peeled off to expose an end portion of the electric equipment wire 110. At this time, the first sheath 111 is peeled off so as to have a larger length than the shield wire 120.

After the second sheath 121 and the first sheath 111 are partially peeled off to expose the parts of the electric equipment wire 110 and the shield wire 120 to the outside, the second connection terminal 141 is pressed and connected to the shield wire 120, and the first connection terminal 112 is connected to the end portion of the electric equipment wire 110.

Then, a part of the first connection terminal 112 and the exposed part of the electric equipment wire 110, to which the first connection terminal 112 is connected, are placed in a mold for forming the insulating member, and injection molding liquid for the insulating member is injected to integrate the insulating member 130 with the part of the first connection terminal 112 and the electric equipment wire 110.

Then, the electric equipment cable having the insulating member 130 fixed thereto is placed in a mold for forming the grounding member, and injection molding liquid for the grounding member is injected to integrate the grounding member 140 with the insulating member 130 and the second connection terminal 141 coupled to the shield wire 120.

When the grounding member 140 is integrated with the insulating member 130, an end portion of the insulating member 130, facing the electric equipment, is exposed as illustrated in FIGS. 3 and 4. That is, the grounding member 140 is not in contact with the first connection terminal 112 connected to the electric equipment wire 110.

When the insulating member 130 and the grounding member 140 are integrated with the electric equipment wire 110 and the shield wire 120 and constitute the electric equipment cable, the electric equipment cable is connected to the electric equipment. That is, the first connection terminal 112 connected to the electric equipment wire 110 is connected to the power supply unit or signal transmission unit of the electric equipment installed in the electric equipment housing 101, and the grounding member 140 connected to the shield wire 120 is coupled to the electric equipment housing 101 while being in contact with the electric equipment housing 101.

In accordance with the embodiment of the present invention, the electric equipment wire and the insulating member are formed and integrated with each other and insulated from the electric equipment housing, and the grounding member made of a conductive plastic material integrated with the shield wire to the electric equipment housing. Thus, since the shield wire is not exposed to the outside, interference with other parts can be avoided to prevent a damage of the parts.

Furthermore, since the grounding member is formed of a conductive plastic material through injection molding, an operation of connecting the separate grounding member to the shield wire to connect the connection terminal installed on the electric equipment housing in the related art can be omitted, which makes it possible to improve the workability during an operation of connecting the electric equipment cable to the equipment.

While the present invention has been described with respect to the specific embodiments, it will be apparent to those skilled in the art that various changes and modifications may be made without departing from the spirit and scope of the invention as defined in the following claims.

What is claimed is:

1. A shield wire grounding device of electric equipment, comprising:

an electric equipment wire electrically connected to the electric equipment, covered by a first sheath, and having an end portion exposed to the outside of the first sheath;

a shield wire installed outside the first sheath, and covered by a second sheath;

an insulating member covering the exposed portion of the electric equipment wire; and a grounding member covering the shield wire and the insulating member, electrically connected to the shield wire, and grounded to an electric equipment housing; and a connection terminal connected to the end portion of the electric equipment wire and having a portion covered by the insulating member.

2. The shield wire grounding device of claim 1, wherein the grounding member is integrated with the outsides of the shield wire and the insulating member through injection molding.

3. The shield wire grounding device of claim 1, wherein the shield wire has one end portion exposed to the outside of the second sheath, with an other connection terminal installed at the exposed portion of the shield wire, and the other connection terminal electrically connects the grounding member to the shield wire.

4. The shield wire grounding device of claim 3, wherein the other connection terminal has a locking protrusion formed protrusively thereon.

5. The shield wire grounding device of claim 4, wherein the locking protrusion is formed in a direction perpendicular to the longitudinal direction of the electric equipment wire.

6. The shield wire grounding device of claim 1, wherein the insulating member has an end portion exposed to the outside of the grounding member.

7. A shield wire grounding device of electric equipment, comprising:

an electric equipment wire electrically connected to the electric equipment, covered by a first sheath, and having an end portion exposed to the outside of the first sheath;

a shield wire installed outside the first sheath, and covered by a second sheath;

an insulating member covering the exposed portion of the electric equipment wire; and a grounding member covering the shield wire and the insulating member, electrically connected to the shield wire, and grounded to an electric equipment housing, wherein the shield wire has one end portion exposed to the outside of the second sheath, with a connection terminal installed at the exposed portion of the shield wire, and the connection terminal electrically connects the grounding member to the shield wire, and wherein the connection terminal has a locking protrusion formed protrusively thereon.

8. The shield wire grounding device of claim 7, wherein the grounding member is integrated with the outsides of the shield wire and the insulating member through injection molding.

9. The shield wire grounding device of claim 7, wherein the locking protrusion is formed in a direction perpendicular to the longitudinal direction of the electric equipment wire.

10. The shield wire grounding device of claim 7, wherein the insulating member has an end portion exposed to the outside of the grounding member.

11. The shield wire grounding device of claim 7, further comprising an other connection terminal connected to the end portion of the electric equipment wire.

12. The shield wire grounding device of claim 11, wherein the other connection terminal has a portion covered by the insulating member.

* * * * *